US007775076B2

(12) United States Patent
Schultz et al.

(10) Patent No.: US 7,775,076 B2
(45) Date of Patent: Aug. 17, 2010

(54) PINCH-POINT LOCK-SEAM TUBING, PINCH POINT SEAMING DEVICES, AND METHODS FOR MANUFACTURING STABILIZED LOCK-SEAM TUBING

(76) Inventors: Trevor Dale Schultz, 10895 Gold Creek Dr., R4, Komoka, Ontario (CA) N0L 1R0; Steven Mark Schultz, 164 Abigail St., Strathroy, Ontario (CA) N7G 4H4

( * ) Notice: Subject to any disclaimer, the term of this patent is extended or adjusted under 35 U.S.C. 154(b) by 992 days.

(21) Appl. No.: 11/335,822

(22) Filed: Jan. 20, 2006

(65) Prior Publication Data

US 2007/0169528 A1 Jul. 26, 2007

(51) Int. Cl.
*B21C 37/12* (2006.01)
*F16L 9/16* (2006.01)
*F16L 11/00* (2006.01)

(52) U.S. Cl. ..... 72/49; 72/50; 138/135; 138/154

(58) Field of Classification Search ..... 72/48–50; 29/33 D, 33 T; 138/154, 135
See application file for complete search history.

(56) References Cited

U.S. PATENT DOCUMENTS 3,154,037 A * 10/1964 Mayrath ..... 72/52
5,074,943 A 12/1991 Menzel
D376,193 S 12/1996 Lennartsson
D379,358 S 5/1997 Lennartsson
5,720,095 A 2/1998 Lennartsson
6,003,220 A 12/1999 Lennartsson
6,085,801 A 7/2000 Lennartsson
6,513,553 B2 2/2003 Lennartsson
6,561,228 B1 5/2003 Lennartsson

FOREIGN PATENT DOCUMENTS

GB 1168178 10/1969
GB 2213748 8/1989

* cited by examiner

*Primary Examiner*—Dana Ross
*Assistant Examiner*—Mohammad Yusuf
(74) *Attorney, Agent, or Firm*—Gary L. Shaffer

(57) ABSTRACT

Many types of stabilized lock-seam tubing are provided, as well as devices, apparatus and methods for producing such stabilized tubing. Advantageously, pinch-locked tubing according to the invention, which comprise interlocking, spaced pinched deformations of the lock-seam, greatly resists side-slip and other shape deformations, including those typically produced by cutting the tubing, and by ovalizing it. Many permutations of lock-seam pinching rollers and related devices for producing stabilized lock-seam tubing are provided. Pinch roller assemblies of the invention are suitable for use with conventional machines as well as machines adapted specifically for them. Apparatus of the invention are suitable producing helically wound or straight lock-seam tubing.

31 Claims, 10 Drawing Sheets

PINCH-POINT LOCK-SEAM TUBING, PINCH POINT SEAMING DEVICES, AND METHODS FOR MANUFACTURING STABILIZED LOCK-SEAM TUBING

FIELD OF THE INVENTION

The present invention relates to apparatus methods and production of tubing which is commonly made from a single strip of sheet metal by curving the strip onto itself, for example, such as is found in helically wound tubing and in straight-seamed sheet metal tubing. More specifically, methods and apparatus for producing lock-seam tubing from a strip of sheet metal wherein the tubing is arched into a tube having a straight seam, or wound into a tube wherein the seam is helically wound, are provided.

BACKGROUND OF THE INVENTION

Sheet metal tubing is typically used in ventilation systems designed to move quantities of air or other gases from one point to another. A known machine for producing helically wound lock-seam tubing is disclosed in British patent publication GB 2,213,748 (see FIG. 1) which is incorporated herein by reference. In this machine, a metal strip is fed to a forming head by means of drive rollers, and a helically wound lock-seam tube is formed by clinching rollers associated with the forming head.

Another known machine for producing helically wound tubing is disclosed in British patent specification GB 1,168,178, wherein FIGS. 3 and 4 show different seams.

The technology related to such machines is well-known to those skilled in the art. At present, several further developed machines of a similar type are available on the market. However, these machines still suffer from some specific drawbacks.

In the production of helically wound lock-seam tubes of the present type, and of straight-seamed lock-seam tubing, the lock-seam tends to slip, which results in an undesirable change in tube diameter. Moreover, when tubing which is circular in cross-section is ovalized, a similarly undesirable side-slip is usually encountered. The conventional solution to this problem is to increase the pressure of the clinching rollers acting on the lock-seam in the forming head. However, such an increased clinching pressure can distort the seam and, thus cause damage to, and deficiencies in, the lock-seam as well as in the adjacent portions of the metal strip from which the tube is formed. Thus, the adjustment of the clinching pressure is crucial to the quality of the lock-seam. This clinching pressure is difficult to control, and is thus not an effective method for controlling side-slip in lock-seamed tubing.

In addition to the clinching pressure, the operator running the machine must consider several other parameters, such as the thickness of the metal strip, the lubrication of the same, and possible wear of different machine components, for example the rollers. Thus, great demands are made on the skill and experience of the operator.

In spite of the operator's skill, it is hard to avoid slip or sliding in the lock-seam. An undesirable increase of the tube diameter can occur either in production, immediately after the forming head, or during storing, handling and transportation of the tubes. It should be noted that the tube diameter may also be undesirably reduced due to lock-seam slip, for example when tubes are subject to pressure forces from the outside.

The change in tube diameter is always a problem, since the tubes delivered do not fulfill the customers' specifications and requirements. Specific problems are encountered when using the tubes in ventilation duct systems mounted on different premises. For example, vibrations caused by fans and similar equipment can initiate lock-seam slip which, in turn, leads to undesirable leakage of air and pressure drops. In severe cases, lock-seam slip of the ventilation ducts can jeopardize safe function of the whole ventilation system.

In ventilation duct systems, different fittings are connected to the helically wound lock-seam tubes forming the major part of the system. Such fittings are bends, T-pieces, dampers, sound attenuators, etc. The fittings are normally inserted in the end of the tubes, and a sealing ring on the inserted portion of the fitting ensures safe sealing. However, if the tube has an undesirably increased diameter, there is a risk that sufficient sealing cannot be obtained in the joint between the fitting and the tube. This may lead to the leakage and pressure drop problems discussed above, resulting in energy losses and increased running costs.

In other cases, the fitting is not provided with a pre-mounted seal, but the joint between the outside of the fitting and the inside of the tube is filled with a mastic for sealing purposes. If the gap is too large due to an undesirable increased tube diameter, sufficient sealing may not be obtained by means of the mastic. Even if the mastic is safely fastened, problems may arise later due to increased tube diameter caused by vibrations, air pressure peaks, etc.

Further, change in tube diameter is disadvantageous when prefabricated annular fastening devices and the like are to be applied on the outside of the tube: Such devices do not fit if the tube diameter has changed.

An attempt to deal with these problems is found in published U.S. Patent application 2001/0013375 to Lennartsson. Lennartsson '375 discloses a method for producing helically wound lock-seam tubing which is further stabilized by crimping the lock-seam and expanding the lock-seam transversely by means of a transverse roller system. The method of Lennartsson, however, introduces another type of instability into the lock-seam by expanding the entire transverse portion of the seam, which distorts the seam to a disadvantageous extent. This distortion leads to instability and the necessity for using string or sealing means within the lock-seam itself. There is thus a need for lock-seam tubing which is not deformed completely across its entire seam while possessing an increased stability with respect to side-slip. There are similar needs for apparatus and methods for producing such stabilized lock-seam tubing.

SUMMARY OF THE INVENTION

Accordingly, it is an object of the present invention is to remedy the above-mentioned drawbacks by providing a method and an apparatus for producing helically wound lock-seam tubing, and straight-seamed lock-seam tubing, having little or very low risk of lock-seam slip or seam-sliding in any direction. Thus, an object of the present invention is to find a solution to problems shown in Lennartsson '375 as well as other prior art tubing, methods and machines in the art.

Another object of the present invention is to provide methods and apparatus for producing lock-seam tubing which maintains a desired diameter during storage, handling, transportation, ovalizing, delivery, mounting and use.

A further object of the invention is to provide lock-seam tubing in forms which are more stable than those found in the conventional products.

In accordance with these and other objects, a method for producing lock-seam tubing from a metal strip, the strip comprising leading edge portions and trailing edge portions, comprises the steps of: A. feeding the strip to a forming head; B.

forming the strip into tubular form in the forming head, whereby the leading and trailing edge portions of the tubularly formed strip are brought into engagement with one another to form a tube; C. clinching the engaging leading and trailing edge portions of the strip to form a lock-seam on the tube formed in the forming head, such that the lock-seam comprises a leading edge margin and a trailing edge margin; D. feeding the lock-seam tube out of the forming head; and E. effecting compression of a portion of the seam to form a pinch, wherein the pinch is formed substantially across one of the leading edge margin and the trailing edge margin, such that the pinch comprises an interlock, and wherein the interlock is constructed and arranged to minimize the movement of the leading and trailing edges with respect to one another.

In accordance with additional objects of the invention, Step E may be repeated a sufficient number of times so that a desired degree of stability is imparted to the formed tube. Preferably, the pinch does not deform the lock seam across its entire width. This characteristic of the present invention minimizes the distorting effects typically caused with methods which expand transversely the entire width of a portion of a lock-seam. By doing so, such disadvantageous methods an increased likelihood of leakage at a lock-seam point which has been distorted expansively across its entire width.

In accordance with further objects and some preferred embodiments of the invention, the pinches are provided at a multiplicity of locations along the length of the leading edge of the lock-seam. In accordance with other preferred embodiments, the pinches are provided at a multiplicity of locations along the length of the trailing edge of the lock-seam. In accordance with additional preferred embodiments of the invention, the pinches are provided at a multiplicity of locations along the lengths of both the leading and trailing edges of the lock-seam. According to still other advantages of the invention, pinches can be provided in any desired spaced relationship to one another, and on one or both sides of the seam, as well as being effected from outside the tube or inside the tube.

In accordance with yet additional preferred embodiments of the invention, a plurality or multiplicity of pinches are provided at a multiplicity of locations along the length of the lock-seam. Distance between the pinches can be chosen in accordance with various factors, such as, for example, the thickness of the metal from which the tube is being formed, the diameter of the tubing, the thermal cycle which the tubing will undergo, and any other conditions under which the tubing will be used. Distances between pinches on the lock-seam can be effected as desired by using pinch rollers of appropriate diameters, and having one or more pinch pins disposed therein to achieve the desired spacing, pinch forces, and pinch pattern. Spacing can be equal or unequal, on only one of the leading or trailing edges of the lock-seam, or as otherwise might be desired.

For example, according to some preferred embodiments of the invention, the pinches may be provided at a multiplicity of staggered locations along the lengths of both the leading and trailing edges of the lock-seam. According to other aspects of the invention, the staggered pinches may be arranged in any desired and space manner, for instance, the pinches may be quite closely spaced with respect to one another, may be in pairs opposite one another at the same location on the seam, or may be in groups, such as pairs, on the same or opposite sides of the seam.

In yet other embodiments, the staggered pinches are provided within a longitudinal distance along the length of the lock-seam, wherein the longitudinal distance approximates the width of the lock seam. Thus, a first pinch may be provide at a first location on the leading edge and a second pinch may be provided at a second location on the trailing edge of the lock-seam In this manner, both leading and trailing edges of the seam can be pinched while the pinches do not overlap across the width of the seam. In a similar manner, pinches may be provided in pairs in juxtaposition at similar locations on the lock-seam.

In accordance with still other advantages, the invention may be employed to form various types of lock-seam tubing, for example, types where the lock-seam tubing is helically wound, and types where the lock-seam tubing is constructed and arranged such that the lock-seam is substantially parallel to the longitudinal axis of the tubing, that is, lock-seam tubing having substantially straight seams. As another advantage, the edge portions of the strip may be preformed, that is, pre-folded, before step D of feeding the strip into the forming head.

In accordance with additional advantageous aspects of the invention, the compressive forces which form the pinches are directed such that portions of the engaged leading and trailing edges are deformed into one another such that the lock-seam is minimally distorted while conferring the desired degree of stability upon the pinch-locked tubing. Thus, according to some preferred embodiments of the methods of the invention, the pinches are formed substantially by the compression of the engaged leading and trailing edges in a direction substantially perpendicular to the longitudinal axis of the seam, that is, by compressing the outer margins of the leading or trailing edges, or both, toward or into the center of the lock-seam to thereby form a pinch.

In other preferred embodiments, the pinches are formed substantially by the compression of the engaged leading and trailing edges in a direction substantially perpendicular to the longitudinal axis of the tube, that is, by compression of the outer margins of the leading or trailing edges, or both, downwardly toward the center axis of the tube to thereby form a pinch. In yet other preferred embodiments, the pinches are formed substantially by the compression of the engaged leading and trailing edges in directions both substantially perpendicular to the longitudinal axis of the seam, as well as substantially perpendicular to the longitudinal axis of the tube, as well as in any other direction necessary to effect the desired degree of melding of portions of the leading and trailing edges into pinches of the invention.

Pinch-seam tubing according to the invention can be can be formed such that the interlocked lock-seam is formed from inside of the tube, from outside of the tube, or both. In one set of preferred embodiments, the interlocking pinches of the invention are formed by means of at least one roller assembly, the roller assembly being provided with at least one means for forming a pinch in a lock-seam. As one of skill in the art can appreciate, the methods and processes of the invention are adaptable to produce many kinds of lock-seam tubing, including cylindrical tubing of both helical and straight varieties. In other words, the invention encompasses any tubing comprising a lock-seam where that lock-seam has been pinched a sufficient number of times to impart the desired degree of stability and resistance to movement of the leading and trailing edges.

In accordance with certain other objects of the invention, an apparatus for producing lock-seam tubing from a metal strip having longitudinal leading edge portions and longitudinal trailing edge portions is provided. In some preferred embodiments, the apparatus comprises means for feeding the strip to a forming head, means for forming the strip into tubular form in the forming head and for bringing the leading edge portions and the trailing edge portions of the formed strip into engagement with each other to form a tube; a clinching assembly for clinching the leading and trailing edge engaging edge portions of the strip to form a lock-seam on the tube formed in the forming head such that the lock-seam comprises a leading edge margin and a trailing edge margin; means for feeding the lock-seam tube out of the forming head; and pinching means for effecting compression of a portion of the seam to form a pinch, wherein the pinching means is constructed and arranged such that the pinch is formed substantially across one of the leading edge margin and the trailing edge margin, such that the pinch comprises an interlock, wherein the interlock is constructed and arranged to minimize the movement of the leading and trailing edges with respect to one another.

In still other preferred embodiments, the pinching means comprises a rotatable pinch roller, the roller having a seaming groove constructed and arranged to receive the lock-seam portion of the forming tube, wherein the seaming groove comprises a groove face, a leading edge side and a trailing edge side; and wherein the pinch roller comprises means disposed therein for compressing at least one of the leading edge margin and the trailing edge margin of the lock-seam, to form at least one pinch. Preferably, the pinching means is constructed and arranged such that less than the transverse width of the seam is compressed by the pinching means. Moreover, the apparatus may further comprise a drive roller disposed opposite to the pinch roller such that the forming tube passes between the drive roller and the pinch roller as the tube is forming.

In some preferred embodiments, the drive roller and the pinch roller are constructed and arranged such that the relative pressure on the forming tube and on portions of the lock-seam is adjustable to suit a desired result. Thus, the pressure exerted by a pinch pin according to the invention is preferably in the range between 8,000 psi (pounds per square inch) for lighter gauges of sheet metal and up to about 24,000 psi for heavier gauges.

Preferably, the pinching means comprises at least one pinch pin disposed in the roller, wherein the pinch pin is constructed and arranged to transmit compressive forces to a portion of the lock-seam such that one or a plurality of pinches of desired dimension and position are formed in the seam. Preferably, the compressive forces are directed one or more of sidewise and downwardly on the portions of the lock-seam.

Moreover, in some preferred embodiments, the pinching means comprises a plurality of pinch pins disposed in the roller. In accordance with additional advantages of the invention, the relative positions of the pinch pins with respect to the circumference of the seaming groove of the roller can be constructed and arranged to provide pinches in desired spacing arrangements with respect to one another relative to their positions on the roller and the seam being formed. In other preferred embodiments, the pinching means comprises at least two rollers, wherein each roller has one or a plurality of pinch pins disposed therein.

In some embodiments of pinch rollers according to the invention, each of a plurality of pinch pins is disposed in the same edge side of the roller. In other embodiments, the same edge side of the roller is the trailing edge. Thus, as the sheet metal is fed through the pinch roller assembly, each of the pinch pins on the roller impinges upon the engaged metal leading or trailing edge as the metal travels between the pinch roller and drive roller, to thereby form pinches of desired extent and dimension in the corresponding edge of the lock-seam.

In other embodiments, wherein the plurality of pinch pins are disposed on both edge sides of the pinch roller, each of the pinch pins on the roller impinge upon the engaged metal corresponding leading or trailing edge to thereby form pinches of desired extent and dimension in each of the corresponding edges of the lock-seam.

As yet another advantage, the present invention comprehends and provides for producing interlocked tubing from many types of sheet stock of various metals and of various thicknesses. Thus, typical gauges and corresponding thicknesses of metal sheeting include those of 0.022" or 26 gauge, commonly used to form tubing from 3-14" in diameter; 0.028" or 24 gauge, commonly used to form tubing from 14-26" in diameter; 0.034" or 22 gauge, commonly used to form tubing from 26"-36" in diameter; 0.040" or 20 gauge, commonly used to form tubing from 36-50" in diameter; 0.052" or 18 gauge, commonly used to form tubing from 50-60" in diameter; 0.063" or 16 gauge, commonly used to form tubing from 60"-72" in diameter; 0.078" or 14 gauge, commonly used to form tubing greater than 72" in diameter.

In one aspect, this characteristic is addressed by the nature, number and shape of the pinch pins provided. A pinch pin according to the invention may be of any shape so long as it produces the desired pinches in the tubing. A pinch pin according to the invention can be made of any substance hard enough to transmit the required forces necessary to produce the desired tubing having interlocked seams. Substances particularly suitable include metals, and particularly hardened metals, as well as high-density carbon, such as diamond. Preferably, the pinch pin, or each of the plurality of pinch pins, comprises a pinching face of suitable shape and hardness, and suitably disposed for compressing a portion of the lock-seam. The face of the pin can be of a different shape than that of its base. For example, pinch pins are preferably one or more having pinching face shapes selected from the group including circles, ovals, diamonds, squares, stars, dentate shapes, parallelograms, striations, toroidal shapes, cylinders of any cross-section, including circular and oval, dentate shapes, toruses, triangles, and asterisks.

Moreover, the one or more pinch pins according to the invention may be provided with embossing faces, that is, with shaped faces which are constructed and arranged to emboss into the pinched area of the seam one or more designs, one or numbers or other symbol which has a function in addition to that of forming the pinch. These include trademarks, tracking numbers, custom manufacture indicators such as one or more bar code striations. Apparatus according to the invention can be constructed and arranged to produce different types of pinched lock-seam tubing, for example, tubing which is helically wound or pinched lock-seam tubing wherein the lock-seam is substantially parallel to the longitudinal axis of the tubing.

Apparatus within the scope of the invention include many variations, including those wherein the pinch roller is constructed and arranged to be outside the tube being formed, and the drive roller is constructed and arranged to be inside the tube being formed, as well as those wherein the pinch roller is constructed and arranged to be inside the tube being formed, and the drive roller is constructed and arranged to be outside the tube being formed. The invention also includes any of the pinching rollers combined with conventional tube seaming machines or with new tube seaming machines.

Preferably, both the pinch rollers and the drive rollers of an apparatus according to the invention comprise shafts, respectively, wherein the shafts are rotatably supported by the forming head. In addition, in some embodiments, the apparatus may further comprise means for pre-forming the leading and trailing edge portions of the strip before the strip is fed into the forming head.

As another advantage, a pinch roller of the invention may comprise one or a plurality of carrying means for carrying one or a plurality of pinch pins. By doing so, a variety of replaceable pinch pins may be substituted or installed in the one or more rollers to thereby effect any desired pattern or frequency of pinches, as well as any desired degree or range of compression forces. Moreover, the one or more pinch pins of the invention may be used to emboss the tubing as the interlocking seam is being formed. Thus, the pinch pins may comprise an embossing face useful for marking the tubing. For example, the embossing face of the pinch pin can be constructed and arranged to such that said pinch contains one or more of a symbol, one or more numbers, one or more letters, one or more trademarks, or any other shape. The invention provides therefore for marking the interlocked seam, for example, with a brand, a manufacturing series number, a size symbol, or any other mark.

BRIEF DESCRIPTION OF THE DRAWINGS

The present invention will now be described with reference to the accompanying schematic drawings showing preferred embodiments by way of example only.

FIGS. 7A-7E illustrate schematically a number of pinch points of varying degree according to the present invention.

DESCRIPTION OF EXEMPLARY PREFERRED EMBODIMENTS

In the following descriptions, like numbers refer to corresponding structures of the several FIGURES.

Figure 1:
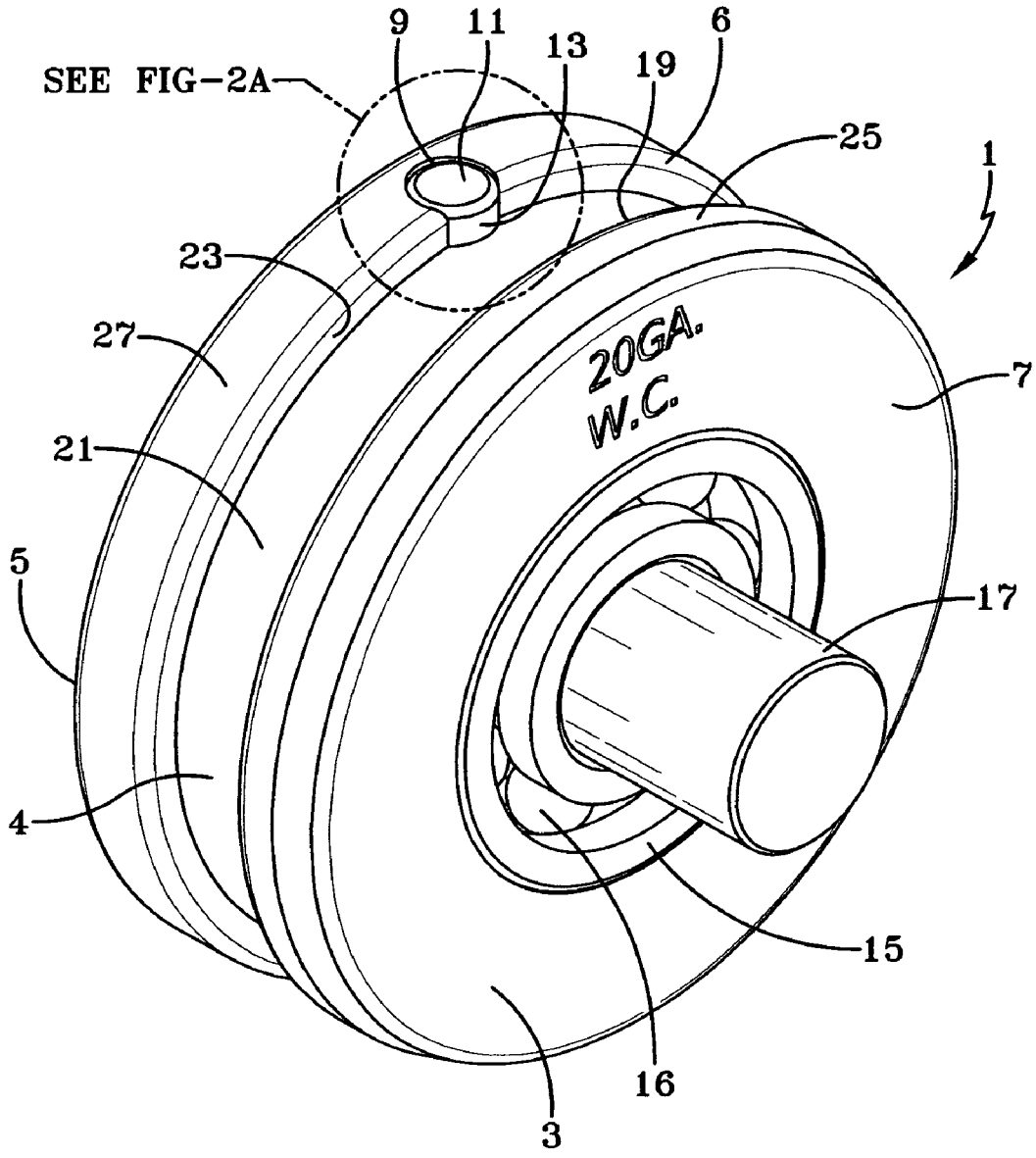
FIG. 1 illustrates schematically a pinch-roller according to the invention.

FIG. 1 illustrates schematically one preferred embodiment of a pinch-roller according to the invention. With respect to FIG. 1, seaming roller assembly 1 is shown. Seaming roller 3 of roller assembly 1 is provided with replaceable leading pinch pin 9 which is exposed across seaming groove trailing surface 23, seaming groove trailing bevel 6 and seaming groove face 21 into the space of seaming groove 4. Pinch pin 9 includes pinch pin face 11, which also extends into the space of seaming groove 4. In other preferred embodiments, pinch pin 9 extends to a further or lesser extent into seaming groove 4, depending upon exemplary factors such as the dimensions and extent of the pinch desired, the gauge of the metal being formed, and the desired stability to be imparted to the formed tube.

Seaming groove 4 of seaming roller 3 is provided is bounded by seaming groove leading surface 19, groove face 21 and seaming groove trailing surface 23. Seaming roller assembly 1 is shown rotatably mounted on seaming roller axial shaft 17, seaming roller bearing ball 16, and seaming roller bearing 15. Seaming roller 1 has leading face 7 and trailing face 5.

Figure 2A:
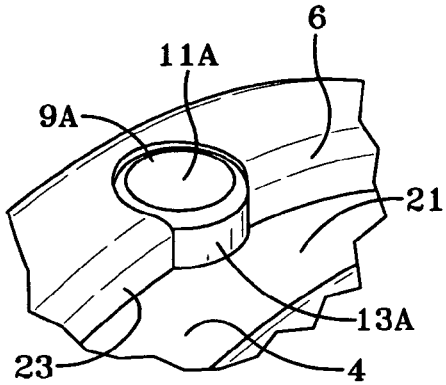
FIGS. 2(*a*)-2(*h*) illustrate schematically several examples of the various shapes of pinch pins according to the invention extending to various degrees into the seaming groove of one preferred embodiment of a pinch roller of the invention.
Figure 2B:
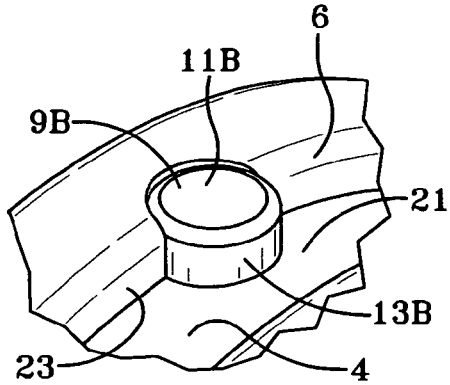

FIGS. 2A-2H illustrate details of the roller of FIG. 1, and show several examples of the various shapes of pinch pins according to the invention extending to various degrees into the seaming groove of one preferred embodiment of a pinch roller of the invention. In FIG. 2A, circularly cylindrical pinch pin 9A has circular pinch pin face 11A and pinch pin pinching surface 13A shown extending across seaming groove trailing surface 23 into seaming grove face 21. In FIG. 2B, circularly cylindrical pinch pin 9B has circular pinch pin face 11B and pinch pin pinching surface 13B. Pin 9B, pinch pin face 11B and pinch pin pinching surface 13B are shown extending across seaming groove trailing surface 23 into seaming groove face 21 to a greater extent than that shown in FIG. 2A.

Figure 2C:
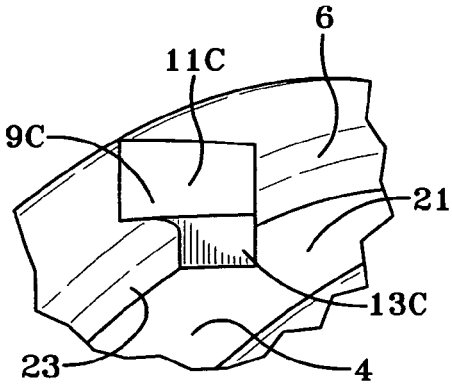
Figure 2D:
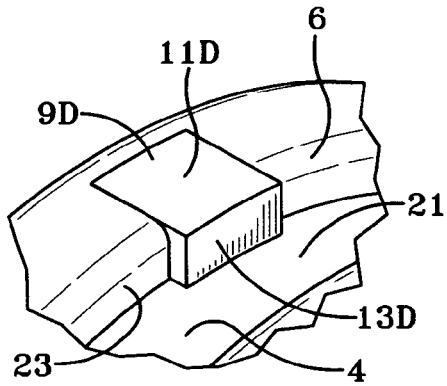

In FIG. 2C, diamond-faced pinch pin 9C has diamond-shaped pinch pin face 11C and pinch pin pinching surface 13C shown extending across seaming groove trailing surface 23 into seaming groove face 21. Pin 9C, pinch pin face 11C and pinch pin pinching surface 13C are shown extending across seaming groove trailing surface 23 into seaming groove face 21. With respect to FIG. 2D, square-faced pinch pin 9D has square-shaped pinch pin face 11D and pinch pin pinching surface 13D. Pinch pin 9D, pinch pin face 11D and pinch pin pinching surface 13D are shown extending across seaming groove trailing surface 23 into seaming groove face 21.

Figure 2E:
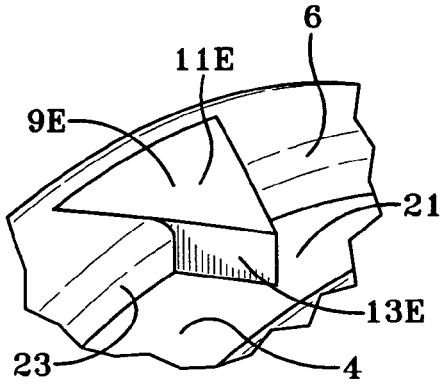
Figure 2F:
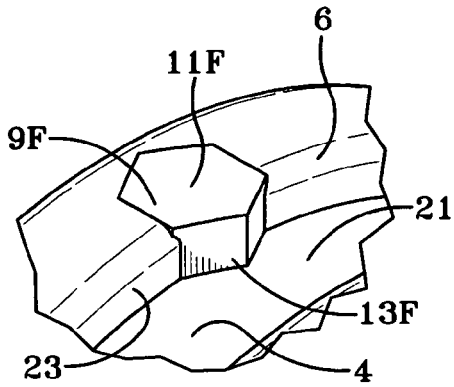

With respect to FIG. 2E, replaceable triangular-faced pinch pin 9E includes triangle-shaped pinch pin face 11E and pinch pin pinching surface 13E. Pinch pin 9E, pinch pin triangular face 11E and pinch pin pinching surface 13E are shown extending across seaming groove trailing surface 23 into seaming groove face 21. FIG. 2F shows replaceable hexagonally-faced pinch pin 9F, having hexagon-shaped pinch pin face 11F and pinch pin pinching surface 13F. Pinch pin 9F is provided with pinch pin face 11F and pinch pin pinching surface 13F shown extending across seaming groove trailing surface 23 into seaming groove face 21.

Figure 2G:
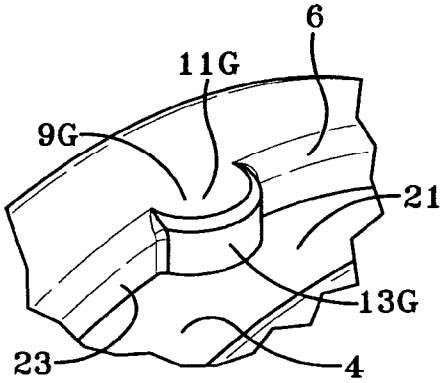
Figure 2H:
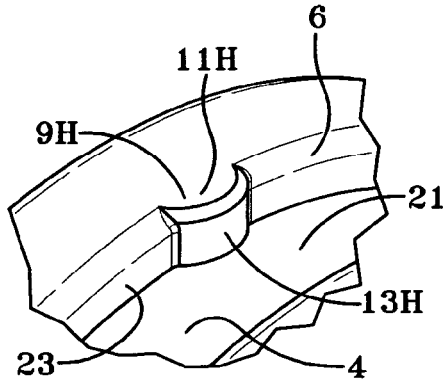

FIGS. 2G and 2H show examples of embodiments of pinch rollers according to the invention where the one or more pinch pins are formed integrally with portions of the roller itself. FIG. 2G shows integral pinch pin 9G, having crescent-shaped pinch pin face 11G and curved pinch pin pinching surface 13G extending from seaming groove trailing surface and seaming groove face 21. Preferably, pinch pin 9G is formed integrally from the same metal from which roller 3 is made, for example, by machining or casting as is known in the metal-forming arts. Any other ways of integrally forming a roller and pin assembly to provide the shape and desired function of the pinch-seaming aspect are also comprehended by the present invention.

FIG. 2H shows an embodiment similar to that of FIG. 2G, except that integral pinch pin H does not extend as far into groove face 21 as pin 11G in FIG. 2G. In FIG. 2H, pinch pin 9H is provided with pinch pin face 11H and pinch pin pinching surface 13H shown extending a desired distance across seaming groove trailing surface 23 into seaming groove face 21.

Figure 3:
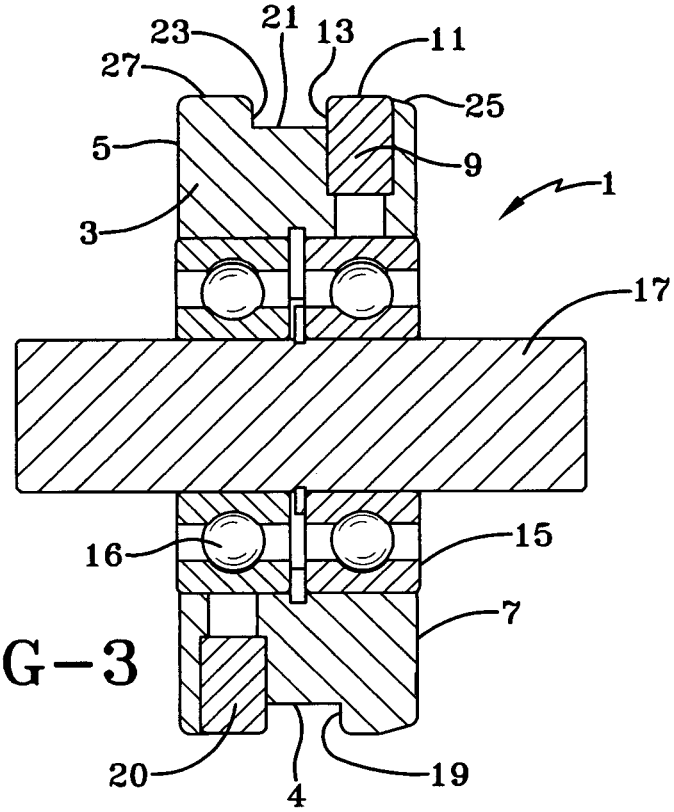
FIG. 3 is a cross-section of a seaming roller assembly according to the present invention.
Figure 4:
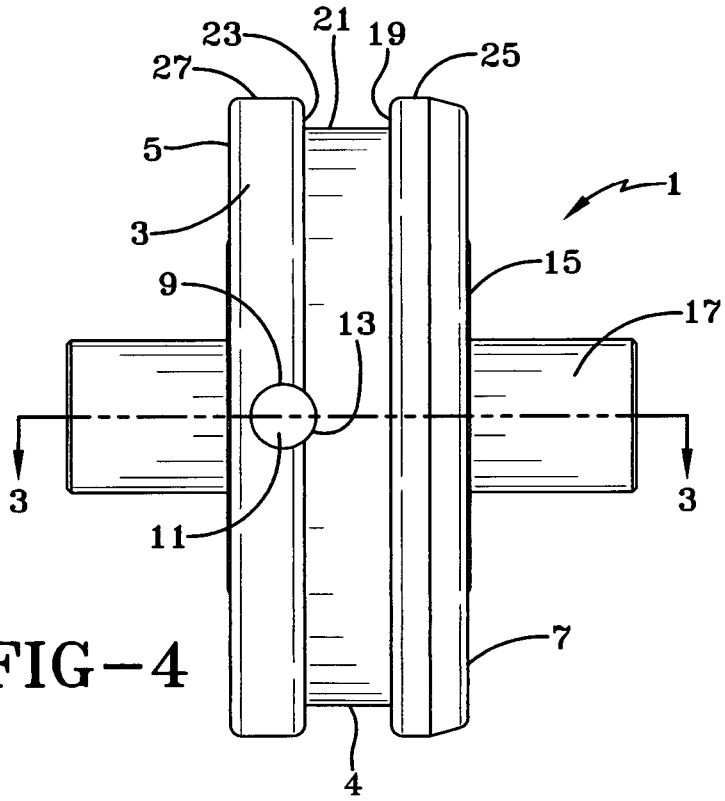
FIG. 4 schematically illustrates a partial view of a seaming roller according to the present invention.

FIG. 3 illustrates schematically a cross-section of pinch seaming roller assembly 1 through section 3 as shown in FIG. 4. With respect to FIG. 3, seaming roller 3 of roller assembly 1 is provided with replaceable leading pinch pin 9 which is exposed across seaming groove trailing surface 19, seaming groove leading bevel 6, and seaming groove face 21 into the space of seaming groove 4. Pinch pin 9 includes pinch pin face 11, and pinch pin pinching surface 13, which also extend into the space of seaming groove 4. Seaming roller 3 of roller assembly 1 is provided also with replaceable trailing pinch pin 20 which is disposed across the trailing surface of groove 4. Thus, pinches can be formed in both the leading and trailing edges of a lock-seam as desired. Trailing pinch pin 4 is exposed a desired distance across seaming groove trailing surface 23, across the seaming groove trailing bevel, and seaming groove face 21 into the space of seaming groove 4. Roller 3 is also provided with pinch seaming roller trailing face 5, and pinch seaming roller leading face 7. Seaming roller assembly 1 is shown rotatably mounted on seaming roller axial shaft 17, seaming roller bearing ball 16, and seaming roller bearing 15. Seaming roller 1 has leading face 7 and trailing FIG. 4 illustrates schematically pinch seaming roller assembly 1. With respect to FIG. 4, seaming roller 3 of roller assembly 1 is provided with replaceable leading pinch pin 9 which is exposed across seaming groove trailing surface 19, seaming groove leading bevel 6, and seaming groove face 21 into the space of seaming groove 4. Pinch pin 9 includes pinch pin face 11, and pinch pin pinching surface 13, which also extend into the space of seaming groove 4. Seaming roller 3 of roller assembly 1 is provided also with replaceable trailing pinch pin 20 which is disposed across the trailing surface of groove 4. Thus, pinches can be formed in both the leading and trailing edges of a lock-seam as desired. Trailing pinch pin 4 is exposed a desired distance across seaming groove trailing surface 23, across the seaming groove trailing bevel, and seaming groove face 21 into the space of seaming groove 4. Roller 3 is also provided with pinch seaming roller trailing face 5, and pinch seaming roller leading face 7. Seaming roller assembly 1 is shown rotatably mounted on seaming roller axial shaft 17.

Figure 5:
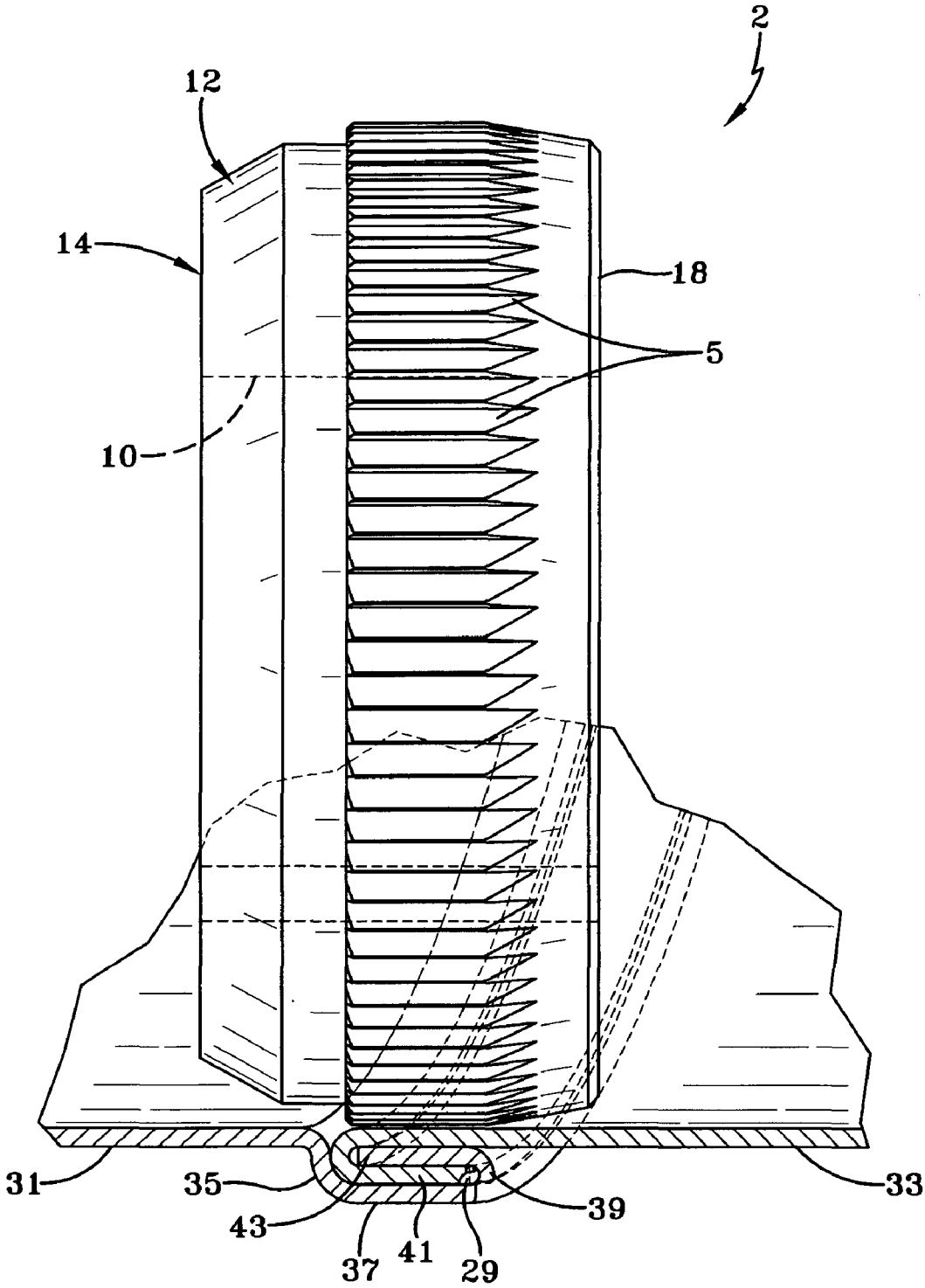
FIG. 5 shows a drive roller according to the invention.

With respect to FIG. 5, drive roller 2 is shown with serrations 5 disposed for gripping workpiece sheet metal to drive the metal between the seaming roller and a pinch-seaming roller, such as pinch roller 3 shown in other FIGS. Drive roller 2 is provided with drive roller leading surface 18 and drive roller trailing surface 14. A drive roller shaft hollow (not shown) is provided for receiving drive roller axle shaft 17, as shown in other FIGS. Drive roller 2 is also provided with feed bevel 12 useful for forming the trailing edge of a work piece through trailing surface 14 of drive roller 2. Drive roller 2 is shown driving trailing metal strip 31 and leading metal strip 33, which are shown engaged with one another, and having leading tucked edge 41 and trailing tucked edge 43. Leading metal strip 33 is provided with leading seam edge 39 and trailing seam edge 35 is provided with trailing tucked edge 43. Pinch 29 is shown formed in the seamed edges, including leading tucked edge 41 of metal strip 33 and trailing tucked edge 43 of metal strip 31.

Figure 6:
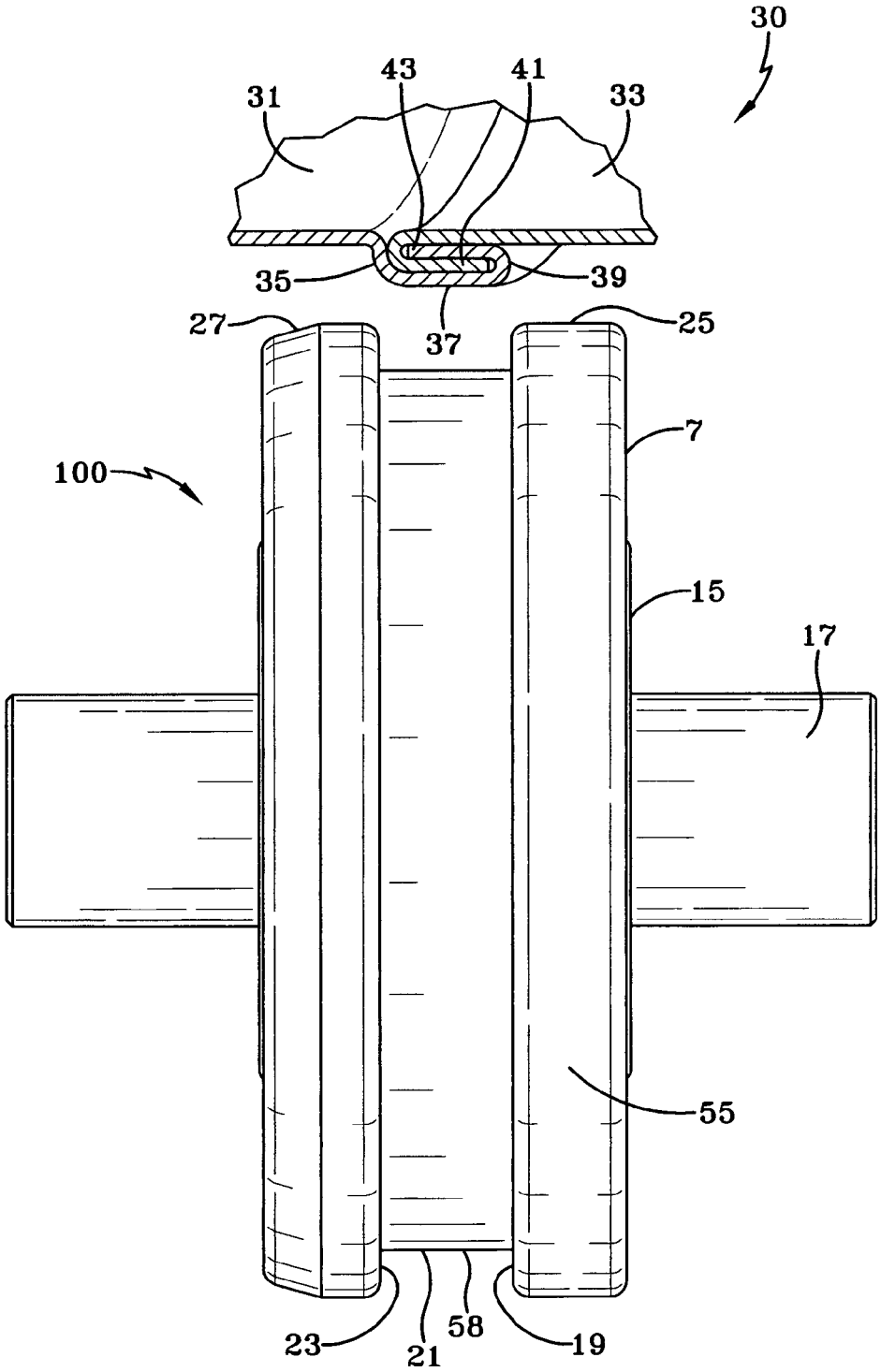
FIG. 6 illustrates a conventional seaming roller in close juxtaposition with a conventional sheet metal lock-seam.

FIG. 6 illustrates a conventional seaming roller in juxtaposition to a conventional sheet metal lock-seam. With respect to FIG. 6, typical conventional seaming roller 100 is shown in proximity to conventional lock-seam 30, typically of the prior art. With respect to FIG. 6, conventional seaming roller 100 is shown in juxtaposition to engaged leading metal strip 33 and trailing metal strip 31. A drive roller (not shown), in cooperation with seaming roller 100, drives trailing metal strip 31 and leading metal strip 33, which are shown engaged with one another and having leading tucked edge 41 and trailing tucked edge 43. Leading metal strip 33 is provided with leading seam edge 39 and trailing seam edge 35 is provided with trailing tucked edge 43. In such a conventional configuration, engaged leading edge 39 and trailing edge 35 are fed into seaming groove 58 where they are forced together by contact with seaming groove trailing surface 23, groove face 21 and seaming groove leading surface 19.

Figure 7:
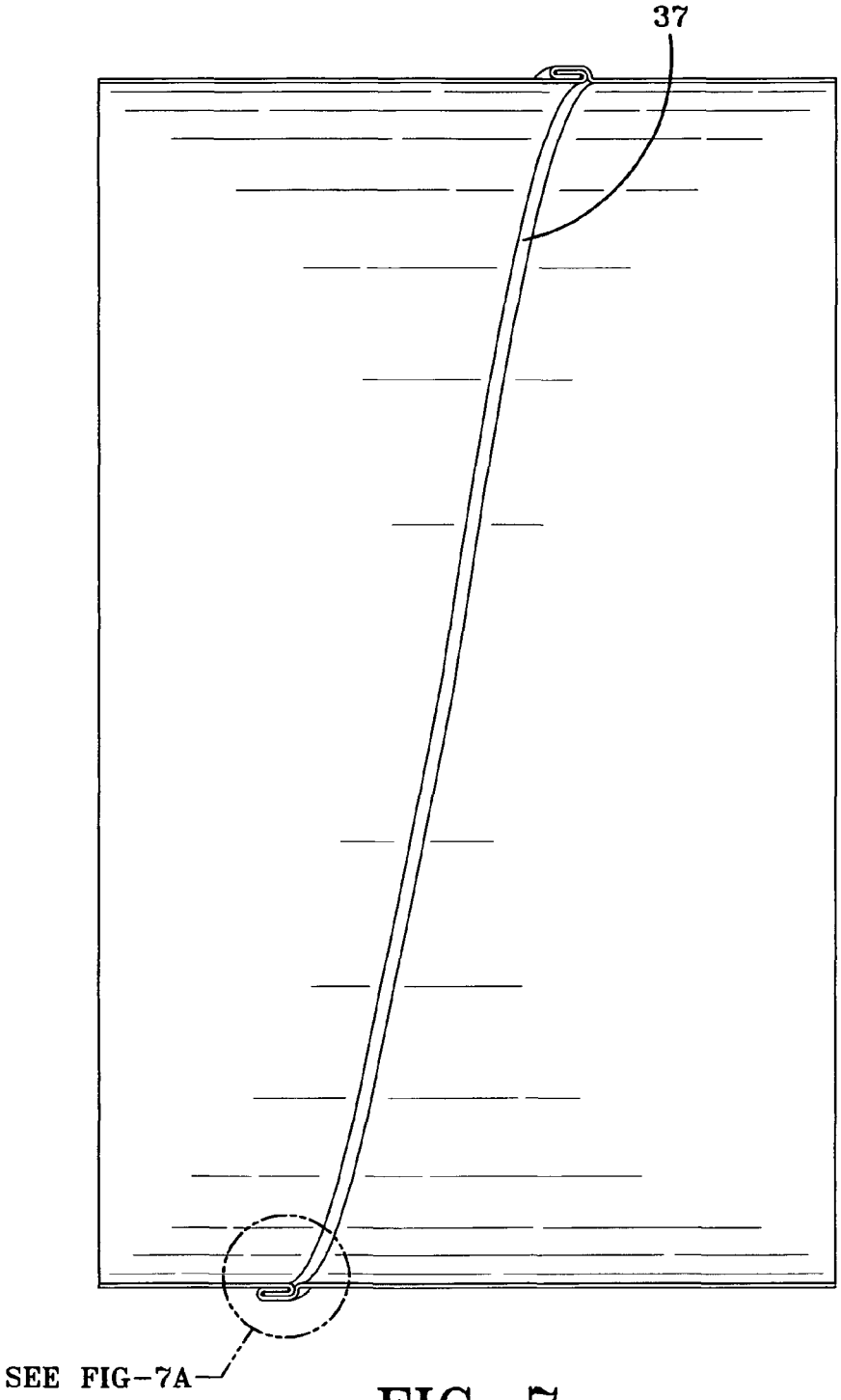
Figure 7A:
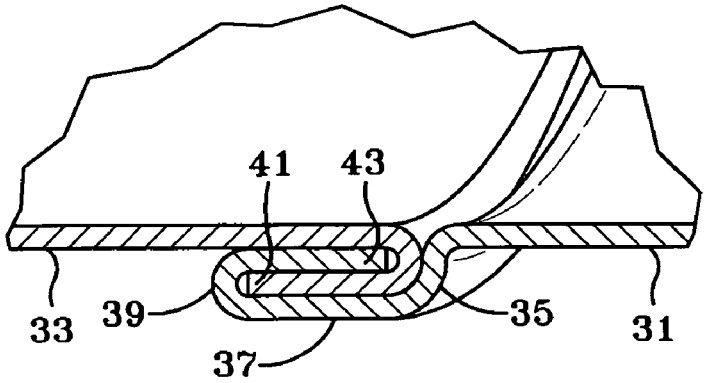
FIG. 7A shows a section of a helically wound tube having a pinch point according to the present invention.

FIG. 7A shows a section of a helically wound tube having tubing seam surface 37 and at least one pinch point according to the present invention.

FIGS. 7A-7E show detailed aspects of pinches of various extents that typically could be formed in the seam of FIG. 7. With respect to FIG. 7A, trailing metal strip 31 and leading metal strip 33 are shown engaged with one another. Leading strip 33 has leading tucked edge 41, and trailing strip 31 has tucked edge 43. Leading metal strip 33 is provided with leading seam edge 39 and trailing seam edge 35 is provided with trailing tucked edge 43. In such a configuration, engaged leading edge 39 and trailing edge 35 are fed into seaming groove (not shown) where they are forced together by contact with the seaming groove trailing and leading surfaces (not shown) and with the groove face (not shown) such that the lock-seam is formed. FIG. 7A shows no pinch according to the invention.

Figure 7B:
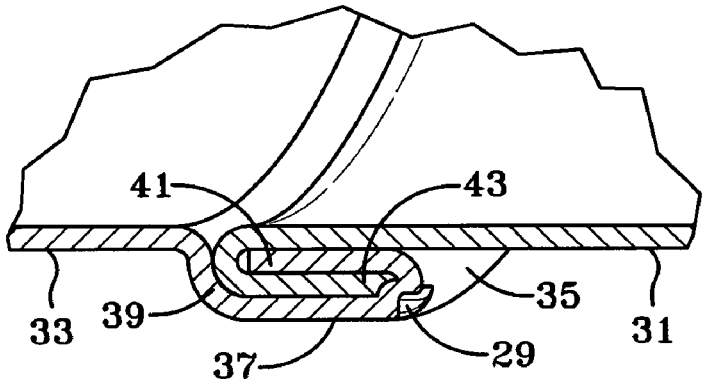

With respect to FIG. 7B, trailing metal strip 31 and leading metal strip 33 are shown engaged with one another. Leading strip 33 has leading tucked edge 41, and trailing strip 31 has tucked edge 43. Leading metal strip 33 is provided with leading seam edge 39 and trailing seam edge 35 is provided with trailing tucked edge 43. In such a configuration, engaged leading edge 39 and trailing edge 35 are fed into seaming groove (not shown) where they are forced together by contact with the seaming groove trailing and leading surfaces (not shown) and with the groove face (not shown) such that the lock-seam is formed. FIG. 7B shows pinch 29 according to the invention, formed in trailing seam edge 35 and compressed into trailing tucked edge 43 of trailing edge metal strip 31 by a pinch pin roller of the present invention such as one or more of those shown, for example, in FIGS. 1, 2A-H, 3, 4, and 8. Thus, the metal of both the leading and trailing edges are compressed into one another.

Figure 7C:
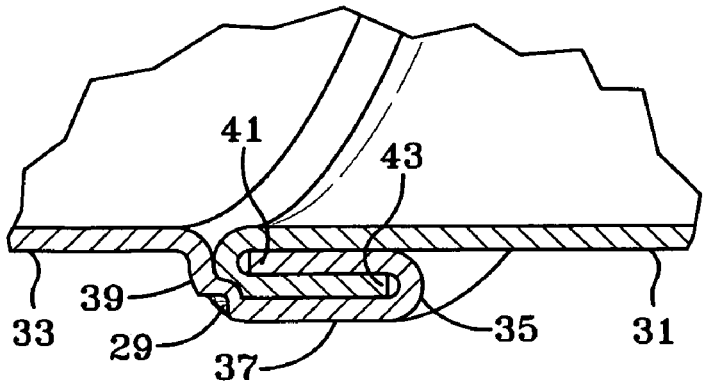

FIG. 7C shows trailing metal strip 31 and leading metal strip 33 engaged with one another as in FIG. 7B. In FIG. 7C, however, pinch point 29 provided in leading seam edge 39 and compressing into trailing tucked edge 43. Thus, the metal of both the leading and trailing edges are compressed into one another.

Figure 7D:
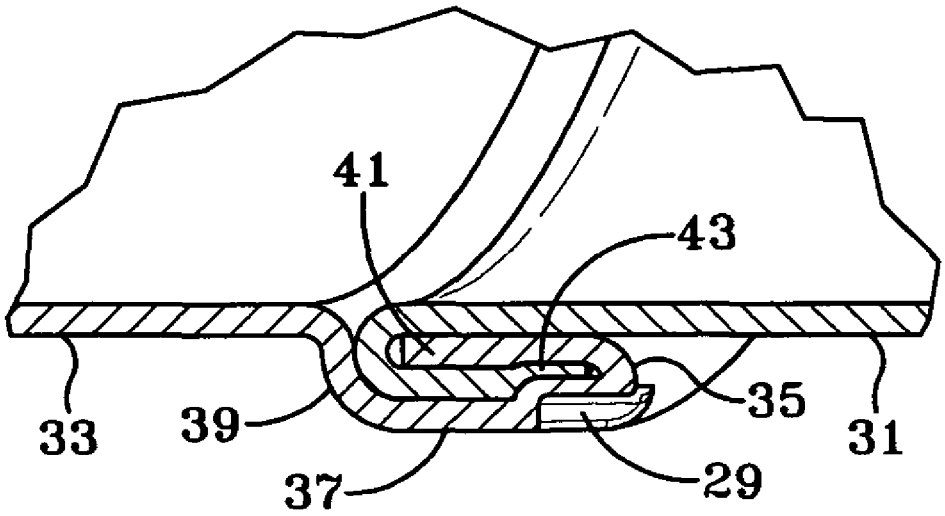

With respect to FIG. 7D trailing metal strip 31 and leading metal strip 33 are shown engaged with one another as in FIG. 7B. In FIG. 7D, however, pinch point 29 is provided much deeper into leading seam edge 39 and more deeply compressed into the metal of trailing tucked edge 43. The metal of trailing tucked edge 43 is also shown more deeply compressed than in the similar seam shown in FIG. 7C. Thus, the metal of both the leading and trailing edges are compressed into one another more deeply than the pinch point shown in FIG. 7C.

Figure 7E:
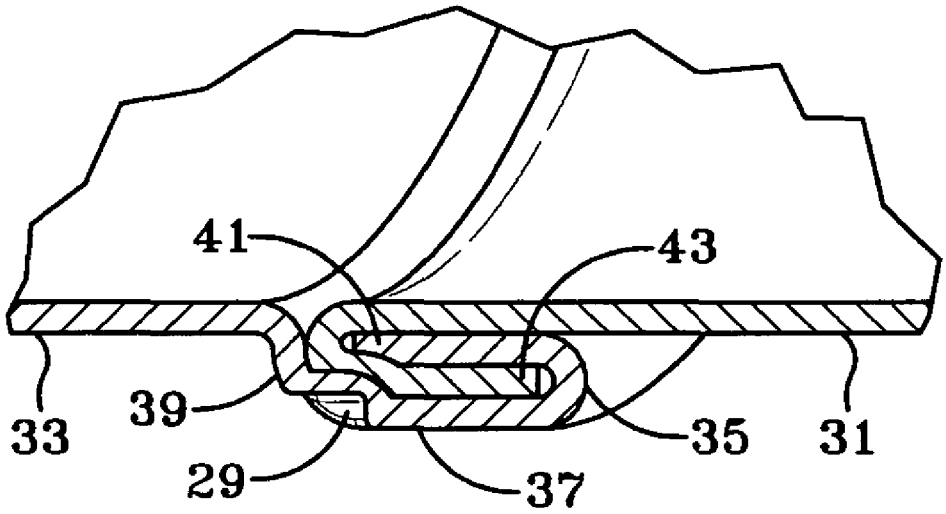

FIG. 7E shows trailing metal strip 31 and leading metal strip 33 engaged with one another as in FIG. 7B. In FIG. 7E, however, pinch point 29 is provided in leading seam edge 39 and compressed into trailing tucked edge 43. Thus, the metal of both the leading and trailing edges are compressed into one another but more deeply than in FIG. 7B.

Figure 8:
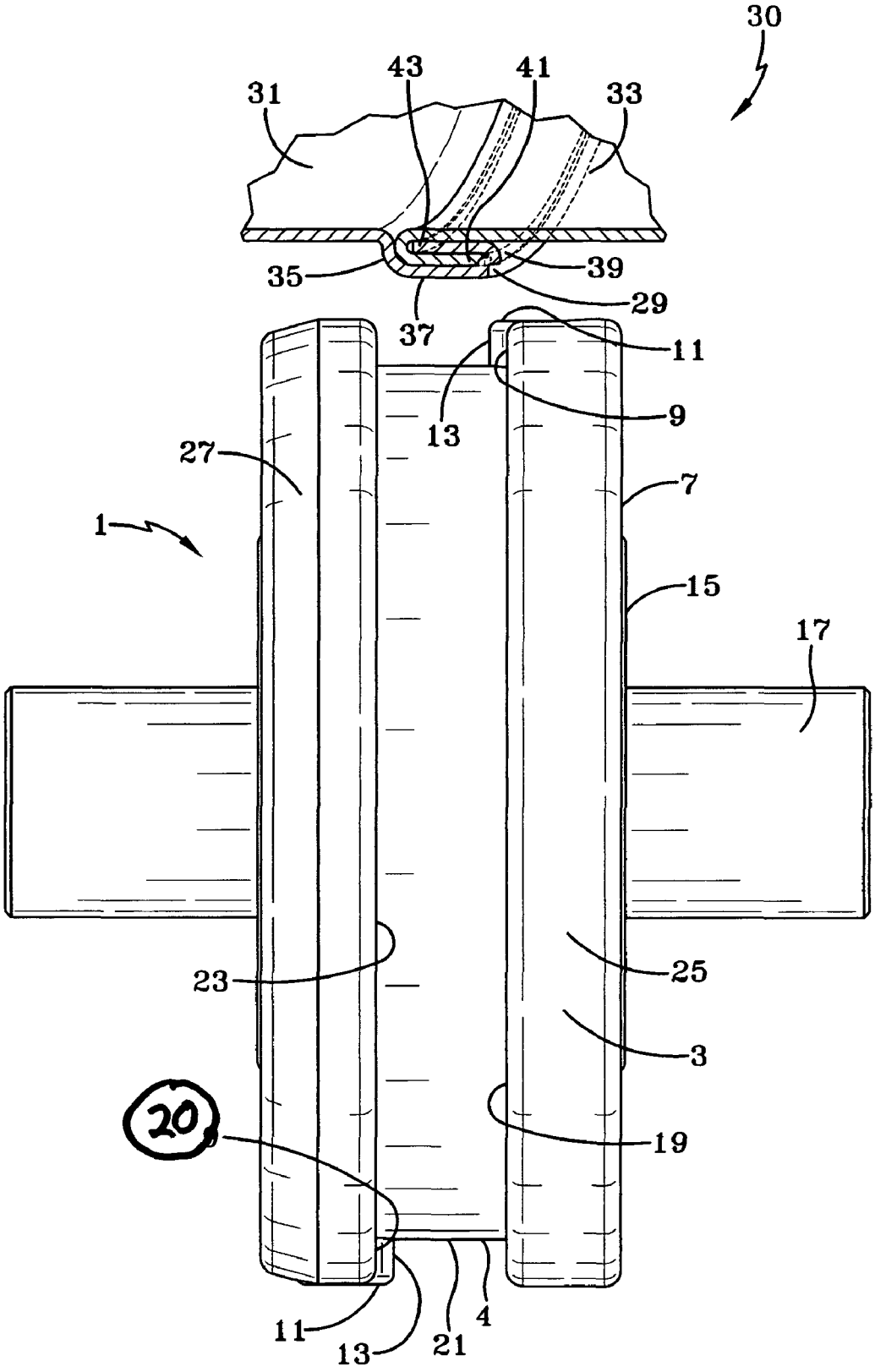
FIG. 8 shows a pinch roller of the present invention comprising two pinch pins located diametrically opposite one another with respect to the diameter of the pinch roller, and located diametrically opposite to one another with respect to the leading and trailing edges of the seeming groove of the pinch roller.

FIG. 8 shows a pinch roller of the present invention comprising two pinch pins located diametrically opposite one another with respect to the diameter of the pinch roller, and located diametrically opposite to one another with respect to the seaming groove edges, one being disposed partially in the leading edge of the seeming groove of the pinch roller and one being disposed in the trailing edge of the seeming groove of the pinch roller. With respect to FIG. 8, a pinch roller of the present invention is shown in juxtaposition to a lock-seamed tube. A drive roller (not shown), in cooperation with seaming roller 3, drives trailing metal strip 31 and leading metal strip 33, which are shown engaged with one another and having leading tucked edge 41 and trailing tucked edge 43 into seaming groove 4. Leading metal strip 33 is provided with leading seam edge 39 and trailing seam edge 35 is provided with trailing tucked edge 43. In such a configuration according to the invention, engaged leading edge 39 and trailing edge 35 are fed into seaming groove 4 where they are forced together by contact with seaming groove trailing surface 23, groove face 21 and seaming groove leading surface 19. As leading edge 39 and trailing edge 35 are forced into groove 4, they are also forced into contact with leading pinch pin 9, having pinching surface 13 and pinching face 11. Leading pinch pin 9 is disposed in leading surface 19 of roller 3. In a similar fashion, as leading edge 39 and trailing edge 35 are forced into groove 4, they are also forced into contact with trailing pinch pin 20, having pinching surface 13 and pinching face 11. Trailing pinch pin 20 is disposed in trailing surface 23 of roller 3. Thus, as leading edge 39 and trailing edge 35 are forced into groove 4, the lock-seam is formed and pinched on both its leading and trailing edges to the extent desired.

Numerous permutations of such aspects such as pinching roller diameters, seaming groove sizes, pinch pins shapes, the number of pinch pins in a roller, the relative locations of the pins in a roller, and the number of rollers in a device according to the invention are within the scope of the present invention. As those of skill in the art will appreciate, numerous permutations of the invention are possible within the metes and bounds of the claims herein. Thus, although the present invention has been described with reference to the preferred embodiments, variations and modifications of elements and components of the invention can be substituted therefore, while remaining within the spirit and scope of the invention.

What is claimed is:

1. An apparatus for producing lock-seam tubing from a metal strip having longitudinal leading edge portions and longitudinal trailing edge portions, comprising:

I. means for feeding said strip to a forming head;

II. means for forming said strip into a tube of tubular form in said forming head and for bringing said leading edge portions and said trailing edge portions of said tubular form into engagement with each other to provide a forming lock-seam tube;

III. a clinching assembly for clinching said leading and trailing edge portions of said forming lock-seam tube to form a lock-seam on said forming tube formed in said forming head such that said lock-seam comprises a leading edge margin, a trailing edge margin and a transverse seam width between said margins;

IV. means for feeding said forming lock-seam tube out of said forming head; and

V. pinching means for effecting compression of portions of said seam to form a series of pinches, wherein said pinching means is constructed and arranged such that each of said pinches is formed substantially across at least one of said leading edge margin and said trailing edge margin, without extending completely across said transverse seam width, such that each of said pinches comprises an interlock, wherein said interlock is constructed and arranged to minimize the movement of said leading and trailing edges with respect to one another.

2. The apparatus of claim 1, wherein said pinching means comprises a rotatable pinch roller having a seaming groove constructed and arranged to receive said lock-seam portion of said forming tube, wherein said seaming groove comprises a groove face, a leading edge side and a trailing edge side; and wherein said pinch roller comprises means disposed therein for compressing at least one of said leading edge margin and said trailing edge margin of said lock-seam, to form said pinch.

3. The apparatus of claim 2, further comprising a drive roller disposed opposite to said pinch roller such that said forming tube passes therebetween as said tube is forming.

4. The apparatus of claim 3, wherein said drive roller and said pinch roller are constructed and arranged such that the relative pressure on said forming tube and on portions of said lock-seam is adjustable.

5. The apparatus of claim 1, wherein said pinching means comprises at least one pinch pin disposed in said roller, wherein said pinch pin is constructed and arranged to transmit compressive forces to a portion of said lock-seam.

6. The apparatus of claim 5, wherein said compressive forces are directed both sidewise and downwardly on said portions of said lock-seam.

7. The apparatus of claim 1, wherein said pinching means comprises a plurality of pinch pins disposed in said roller.

8. The apparatus of claim 5, wherein said plurality of pinch pins are disposed in the same edge side of said roller.

9. The apparatus of claim 8, wherein said same edge side of said roller is said leading edge.

10. The apparatus of claim 8, wherein said same edge side of said roller is said trailing edge.

11. The apparatus of claim 5, wherein said plurality of pinch pins are disposed on both edge sides of said roller.

12. The apparatus of claim 5, wherein each of said pinch pins comprises a pinching face disposed for compressing a portion of said lock-seam.

13. The apparatus of claim 5, wherein said plurality of pinch pins are one or more having pinching face shapes selected from the group including circular cylinders, oval cylinders, squares, triangles, stars, dentate shapes, toruses, diamonds, parallelograms, striations and asterisks.

14. The apparatus of claim 1, wherein said apparatus is constructed and arranged to produce pinched lock-seam tubing which is helically wound.

15. The apparatus of claim 1, wherein said apparatus is constructed and arranged to produce pinched lock-seam tubing wherein said lock-seam is substantially parallel to the longitudinal axis of said tubing.

16. The apparatus of claim 2, wherein said pinch roller is constructed and arranged to be outside said tube being formed, and said drive roller is constructed and arranged to be inside said tube being formed.

17. The apparatus of claim 2, wherein said pinch roller is constructed and arranged to be inside said tube being formed, and said drive roller is constructed and arranged to be outside said tube being formed.

18. The apparatus of claim 1, wherein said pinch roller and said drive roller comprise shafts, respectively, wherein said shafts are rotatably supported by said forming head.

19. The apparatus of claim 1, further comprising means for preforming said leading and trailing edge portions of said strip before said feeding into said forming head.

20. The apparatus of claim 2, wherein said pinch roller comprises carrying means for carrying said pinch pins.

21. The apparatus of claim 2, wherein said pinch roller comprises carrying means for carrying said plurality of pinch pins.

22. The apparatus of claim 2, wherein said pinch pins are replaceable.

23. The apparatus of claim 2, wherein said pinch pins comprise an embossing face.

24. The apparatus of claim 23, wherein said embossing face is constructed and arranged to shape said pinch such that said pinch contains one or more of a symbol, one or more numbers, one or more letters, one or more trademarks, and one or more bar code striations.

25. The apparatus of claim 23, wherein said pinches deform said lock seam a maximum of 10% of the transverse width of said lock-seam.

26. The apparatus of claim 1, wherein said pinches deform said lock seam a maximum of 25% of the transverse width of said lock-seam.

27. The apparatus of claim 1, wherein said pinches deform said lock seam a maximum of 40% of the transverse width of said lock-seam.

28. The apparatus of claim 1, wherein said pinches deform said lock seam a maximum of 55% of the transverse width of said lock-seam.

29. The apparatus of claim 1, wherein said pinches deform said lock seam a maximum of 70% of the transverse width of said lock-seam.

30. The apparatus of claim 1, wherein said pinches deform said lock seam a maximum of 90% of the transverse width of said lock-seam.

31. The apparatus of claim 1, wherein said pinches deform said lock seam a maximum of 95% of the transverse width of said lock-seam.

* * * * *